US009511371B2

(12) United States Patent
Seto et al.

(10) Patent No.: US 9,511,371 B2
(45) Date of Patent: Dec. 6, 2016

(54) GRINDING TYPE VERTICAL GRAIN POLISHING MACHINE

(75) Inventors: Yasuyoshi Seto, Tokyo (JP); Fumio Tajima, Tokyo (JP); Kazuto Nonaka, Tokyo (JP); Yasunori Koike, Tokyo (JP); Koji Yamamoto, Tokyo (JP)

(73) Assignee: Satake Corporation (JP)

( * ) Notice: Subject to any disclaimer, the term of this patent is extended or adjusted under 35 U.S.C. 154(b) by 242 days.

(21) Appl. No.: 14/117,034

(22) PCT Filed: Apr. 23, 2012

(86) PCT No.: PCT/JP2012/060805

§ 371 (c)(1),
(2), (4) Date: Nov. 12, 2013

(87) PCT Pub. No.: WO2012/157402

PCT Pub. Date: Nov. 22, 2012

(65) Prior Publication Data

US 2014/0174302 A1 Jun. 26, 2014

(30) Foreign Application Priority Data

May 13, 2011 (JP) ..... 2011-108283

(51) Int. Cl.

| | |
|---|---|
| ***B02B 3/00*** | (2006.01) |
| ***B02B 3/04*** | (2006.01) |
| ***B02B 3/08*** | (2006.01) |
| ***B02B 7/02*** | (2006.01) |

(52) U.S. Cl.
CPC . *B02B 3/00* (2013.01); *B02B 3/04* (2013.01); *B02B 7/02* (2013.01)

(58) Field of Classification Search
CPC ..... B02B 3/00
USPC ..... 99/519, 523
See application file for complete search history.

(56) References Cited

U.S. PATENT DOCUMENTS 4,583,455 A * 4/1986 Salete-Garces ..... B02B 3/00 99/519
5,413,034 A * 5/1995 Satake ..... B02B 3/04 99/519

FOREIGN PATENT DOCUMENTS

| | | | |
|---|---|---|---|
| CN | 1727064 | A | 2/2006 |
| JP | S63-49308 | Y2 | 12/1988 |
| JP | S64-30654 | A | 2/1989 |
| JP | H08-299811 | A | 11/1996 |
| JP | 3266167 | B2 | 3/2002 |
| JP | 2010-162473 | A | 7/2010 |

* cited by examiner

*Primary Examiner* — Tu B Hoang
*Assistant Examiner* — Thomas Ward
(74) *Attorney, Agent, or Firm* — Lerner, David, Littenberg, Krumholz & Mentlik, LLP

(57) ABSTRACT

A bran removing wire-mesh tube includes: bran removing wire-mesh tube parts 28 divided in more than one in a circumferential direction in planar view; and a plurality of support pillars 33 erected at intervals in the circumferential direction to respectively fix both side edges of the divided bran removing wire-mesh tube parts 28. Each of the support pillars 33 is provided with an elongated resistor 34 that suppresses grains from moving in the circumferential direction along with rotation of grinding type grain cleaning rolls 26. The resistor 34 is urged by an elastic member 37 to a position at which the resistor 34 protrudes toward the inside of a grain cleaning chamber 30. Further, the resistor 34 is provided so as to be movable in a radial direction to a position farther from the grain cleaning chamber 30 due to resistance from the grains.

7 Claims, 15 Drawing Sheets

GRINDING TYPE VERTICAL GRAIN POLISHING MACHINE

BACKGROUND

Technical Field

The present invention relates to a grinding type vertical grain polishing machine including a resistor apparatus that restricts movement of grains and adjusts the degree of grinding of the grains when the grains are polished by grinding.

Background Art

A grain polishing machine described in Patent Literature 1 is exemplified as a conventional grain polishing machine. This grain polishing machine is described with reference to the drawings. FIG. 15 is a cross sectional view of a grain polishing unit of the conventional grain polishing machine, and illustrates part of the state where a grinding roll member is fitted to a main shaft 101. The grinding roll member is formed by alternately stacking a plurality of grinding rolls 102 and a plurality of spacers 103 in the vertical direction. In this figure, porous tubular members 105 are provided on the outer side in the radial direction of the grinding rolls 102 so as to surround the grinding rolls 102 with an interval from the outer circumferential surfaces of the grinding rolls 102, whereby a grain cleaning chamber 104 is formed between the porous tubular members 105 and the grinding rolls 102.

Each porous tubular member 105 is placed between adjacent ones of support pillars 106 that are provided at intervals in the circumferential direction. FIG. 15 illustrates four support pillars 106 and four porous tubular members 105. Then, each support pillar 106 is provided with a resistor 107 that protrudes toward the grain cleaning chamber 104. The resistor 107 serves to suppress grains from moving in the circumferential direction along with rotation of the grinding rolls 102 to thereby improve the grinding performance. The resistor 107 is an elongated member that is long in the axial direction of the main shaft 101 and is vertically placed so as to extend across the plurality of grinding rolls 102 attached to the main shaft 101.

Each support pillar 106 is further provided with protrusion amount adjusting means 108 for independently adjusting the amount of protrusion of each resistor 107 in the radial direction, and the amount of protrusion of the resistor 107 is manually adjusted (see arrows in FIG. 15). Note that, in this figure, reference sign 109 denotes a support pillar cover, reference sign 110 denotes a bran removing chamber cover, and reference sign 111 denotes a discharged grain receiver into which polished grains are discharged.

According to this configuration, the interval between each resistor 107 and the outer circumferential surfaces of the grinding rolls 102 is independently adjusted by the protrusion amount adjusting means 108 provided to each support pillar 106, and the resistance to movement (the degree of suppression in movement) of the grains in the grain cleaning chamber 104 can be adjusted. As a result, the grinding performance of the grinding rolls 102 on the grains can be adjusted at a portion of each resistor. Moreover, there is an advantage that a resistance state to a flow of the grains can be finely adjusted and changed in accordance with properties of crude grains to be polished and a shape required as a product.

Unfortunately, in the above-mentioned, grain polishing machine, the number of the protrusion amount adjusting means 108 respectively provided to the support pillars 106 is more than one (in FIG. 15, four in the circumferential direction; further, the protrusion amount adjusting means 108 may be provided at a plurality of portions in the main shaft 101 direction), and hence there is a problem that the adjustment takes a long time. Moreover, some operators may not be used to such adjustment using the protrusion amount adjusting means 108. Hence, there is a problem that, if the gap between each resistor 107 and the outer circumferential surfaces of the grinding rolls 102 is set to be extremely small, the grains are caught in the gap, and broken rice occurs if the grains are rice grains.

LIST OF CITATIONS

Patent Literature

Patent Literature 1: Japanese Patent No. 3266167

SUMMARY

Technical Problem

In order to solve the above-mentioned problems, the present invention has a technical object to provide a grinding type vertical grain polishing machine including a resistor apparatus that does not require an operator to manually adjust the amount of protrusion of a resistor.

Solution to the Problem

In order to achieve the above-mentioned object, the present invention provides a grinding type vertical grain polishing machine including: a bran removing wire-mesh tube erected in a top-bottom direction; a main shaft rotatably provided inside of the bran removing wire-mesh tube; a grinding type grain cleaning roll member integrally including a large number of grinding type grain cleaning rolls axially supported by the main shaft; a grain cleaning chamber formed between the bran removing wire-mesh tube and the grinding type grain cleaning roll member; and a bran removing chamber and a resistor apparatus each formed on an outer circumferential side of the bran removing wire-mesh tube. The following technical means is used for the resistor apparatus.

That is, the resistor apparatus includes: a plurality of support pillars erected around the bran removing wire-mesh tube; and a resistor and an urging apparatus therefor provided for each of the support pillars.

The resistor has a leading end surface that approaches an outer circumferential surface of the grinding type grain cleaning roll member inside of the grain cleaning chamber, to thereby impart a resistance for suppressing movement to grains moving along with rotation of the grinding type grain cleaning roll member. A position of the leading end surface is adjustable so as to be closer to or farther from the outer circumferential surface of the grinding type grain cleaning roll member in a radial direction of the grinding type grain cleaning roll member. The resistor is always urged by the urging apparatus toward the grinding type grain cleaning roll member. When pressing force of the grains exceeds the urging by the urging apparatus, the resistor is retracted from the grinding type grain cleaning roll member against the urging.

In the grinding type vertical grain polishing machine, in addition to the above-mentioned configuration, the bran removing wire-mesh tube may be configured as bran removing wire-mesh tube parts that are divided in more than one in a circumferential direction in planar view, and the plurality of support pillars of the resistor apparatus may be erected at intervals in the circumferential direction in order to respectively fix both side edges of the bran removing wire-mesh tube parts divided in more than one.

In the grinding type vertical grain polishing machine, in addition to the above-mentioned configuration, the resistor may be formed so as to have an elongated shape long in an axial direction of the grinding type grain cleaning roll member.

In the grinding type vertical grain polishing machine, in addition to the above-mentioned configuration, in order to adjust urging force of the resistor at a position at which the resistor protrudes toward an inside of the grain cleaning chamber, each of the support pillars may be provided with a resistor apparatus that makes the urging force adjustable by a turn position of a pressure adjusting dial.

In the grinding type vertical grain polishing machine, in addition to the above-mentioned configuration, the resistor may be formed such that one end edge thereof extending in an axial direction and each of the support pillars are supported by a hinge, while another end edge thereof is interlocked with the urging apparatus so as to be turnable about the hinge.

In the grinding type vertical grain polishing machine, in addition to the above-mentioned configuration, each of the support pillars may be provided with an external air take-in port and an air jet port, the air jet port may be placed on a downstream side of the resistor of the resistor apparatus with respect to a flow of the grains and at a portion close to the resistor, and air may be jetted from the air jet port toward the grain cleaning chamber.

In the grinding type vertical grain polishing machine, in addition to the above-mentioned configuration, the urging by the urging apparatus may be achieved by an elastic member such as a spring, an elastic resin block, and an elastic resin piece.

In the grinding type vertical grain polishing machine, in addition to the above-mentioned configuration, the urging by the urging apparatus may be achieved by an air pressure such as an air cylinder and an air damper.

Advantageous Effects of Invention

In the present invention, as described above, in the resistor apparatus of the grinding type vertical grain polishing machine, the resistor that imparts a resistance for suppressing movement to the grains moving along with rotation of the grinding type grain cleaning roll member is configured in the following manner. That is, the position of the leading end surface is adjustable so as to be closer to or farther from the outer circumferential surface of the grinding type grain cleaning roll member in the radial direction of the grinding type grain cleaning roll member. The resistor is always urged by the urging apparatus toward the grinding type grain cleaning roll member. When the pressing force of the grains exceeds the urging by the urging apparatus, the resistor is retracted from the grinding type grain cleaning roll member against the urging. Accordingly, the resistor is always urged to the position at which the resistor protrudes toward the inside of the grain cleaning chamber, and an operator does not need to manually adjust the amount of protrusion of the resistor.

In this state, the grains in the grain cleaning chamber are moving while being subjected to active flow actions (revolution and rotation) under a low pressure. Then, during such movement, the grains come into contact with the circumferential surfaces of the grinding type grain cleaning rolls, whereby the surface layers of the grains are ground. Meanwhile, under such a high pressure that broken grains (broken rice if the grains are rice grains) may occur in the grain cleaning chamber, the pressing force of the grains exceeds the urging force of the urging apparatus, and the resistor is automatically moved in a direction farther from the grain cleaning rolls. As a result, in the grain cleaning chamber, desired grain cleaning is performed without the occurrence of broken grains. Accordingly, also in this case, the trouble of manually adjusting the amount of protrusion is eliminated.

The bran removing wire-mesh tube is divided in more than one in the circumferential direction in planar view, the support pillars of the resistor apparatus are erected at intervals in the circumferential direction, and both side edges of the divided parts of the bran removing wire-mesh tube are respectively fixed by the plurality of support pillars. In such a configuration, the support pillars of the resistor apparatus can be used to attach the bran removing wire-mesh tube, and a structure for supporting the bran removing wire-mesh tube can be simplified. Moreover, for the resistor attached to the support pillar, a configuration for causing the leading end surface to face the grain cleaning chamber and a configuration for introducing jetted air to the grain cleaning chamber are simplified.

According to the resistor apparatus that makes the urging force adjustable by the turn position of the pressure adjusting dial, the urging force of the resistor at the position at which the resistor protrudes toward the inside of the grain cleaning chamber can be adjusted, and an operator can finely adjust and change a resistance state of the resistor to the flow (movement) of the grains, in accordance with properties of a crude material, a shape required as a product, and the like.

The resistor is configured as an elongated plate-like resistor extending in the axial direction, and is formed such that one end edge thereof is supported by the support pillar using the hinge, while another end edge thereof is interlocked with the urging force adjusting apparatus of the resistor so as to be turnable about the hinge. In such a configuration, the degree of resistance can be easily adjusted by a turn angle of the elongated plate-like resistor. Moreover, in the configuration in which the resistor turns about the hinge, the resistance to the grains can be easily adjusted along movement of the grains, and the movement of the grains is less likely to be unnecessarily disturbed.

The external air take-in port is pierced through each of the support pillars, and the air jet port for jetting air toward the grain cleaning chamber is provided on the downstream side of the resistor in the movement direction of the grains. In such a configuration, the gap between the resistor and the support pillar is a region through which the grains do not pass or a region through which few grains pass, and hence the jetted air can be smoothly taken in.

If the member that imparts the urging is configured as an elastic member such as a spring and elastic resins in the urging apparatus, the member can be less expensive and simpler in structure.

If the member that imparts the urging is configured as an air actuator in the urging apparatus, the resistance of the resistor to movement of the grains can be more precisely adjusted or actively adjusted, in combination with a pressure detecting sensor and the like. Moreover, if an air damper is used, the responsiveness of resistance adjustment is smoother, and the movement of the grains is less likely to be disturbed, compared with the case of the elastic member.

DESCRIPTION OF EMBODIMENTS

Embodiments of the present invention are described with reference to the drawings.

[First Embodiment]

(Overall Configuration)

Figure 1:
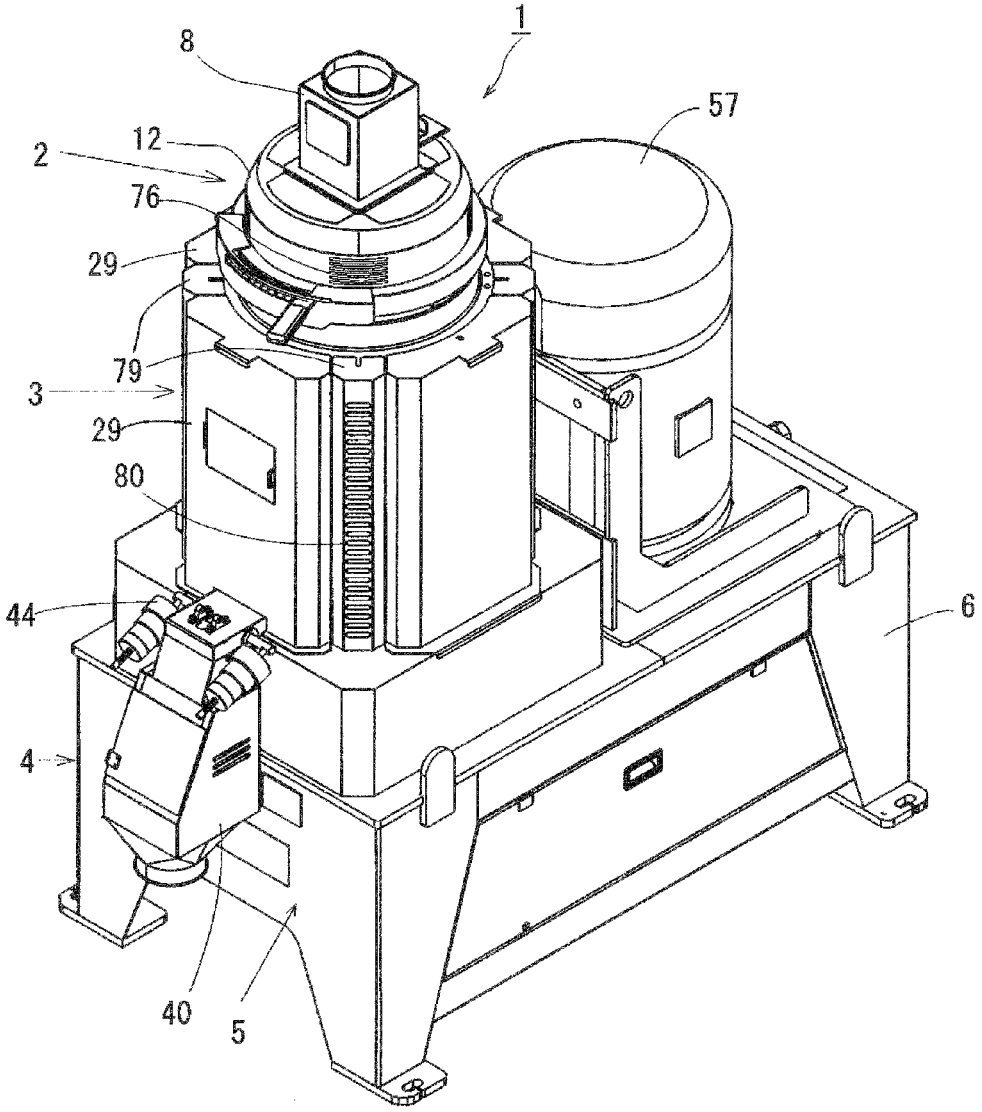
FIG. 1 is a perspective view of a grinding type vertical grain polishing machine.
Figure 2:
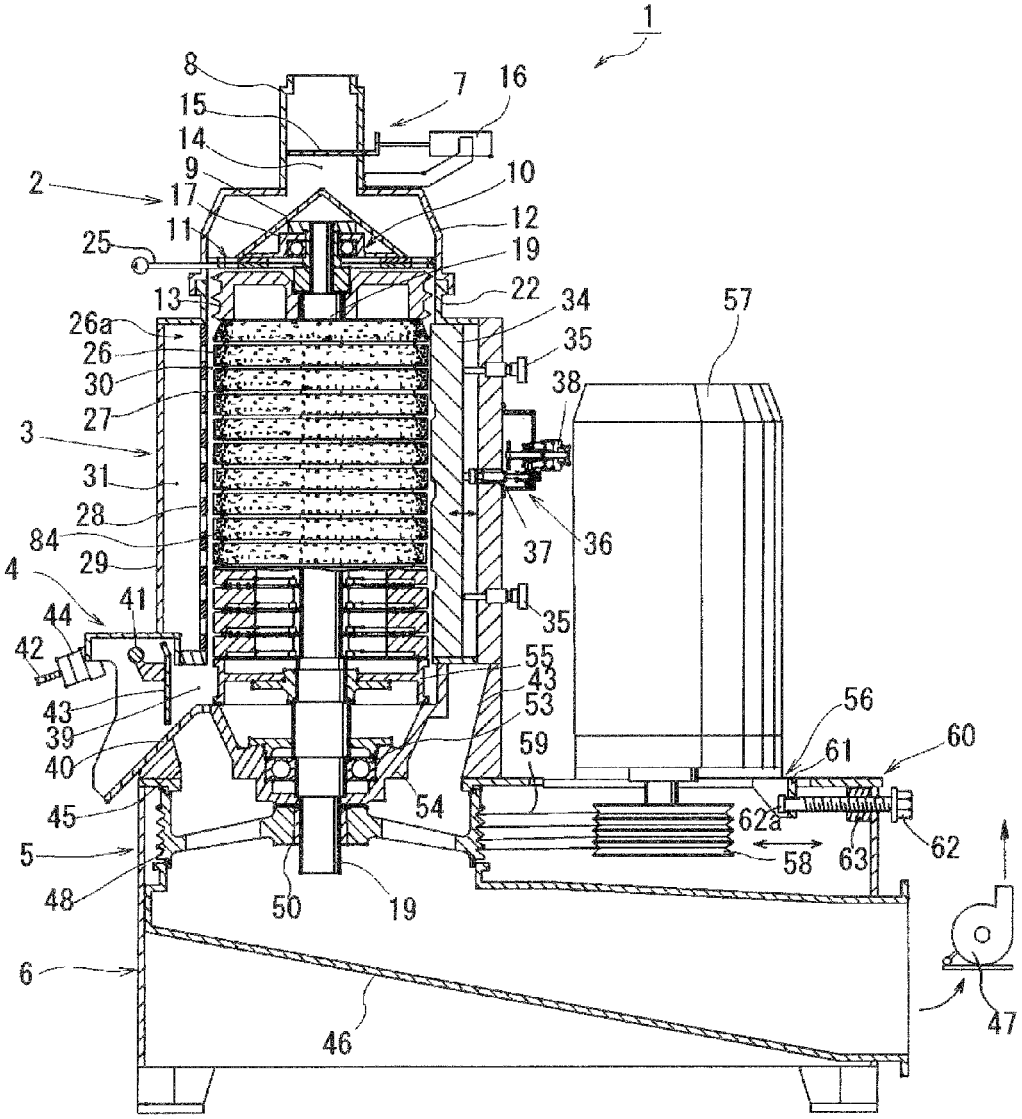
FIG. 2 is a front view illustrating a longitudinal cross section of part of the grinding type vertical grain polishing machine (first embodiment).

As illustrated in FIG. 1 and FIG. 2, a grinding type vertical grain polishing machine 1 according to an embodiment of the present invention includes, as main components: a grain supplying unit 2 that supplies crude grains to be polished; a grain grinding/polishing unit 3 that polishes the grains received from the grain supplying unit 2 while sending the grains downward; a grain discharging unit 4 that discharges the grains polished by the grain grinding/polishing unit 3; a bran collecting unit 5 (FIG. 2) that collects bran that is separated from cleaned grains by the grain grinding/polishing unit 3; and a main body base unit 6 that supports a machine body and a motor serving as a driving source.

(Grain Supplying Unit)

The grain supplying unit 2 includes: a grain supplying tube 8 that receives the crude grains supplied from a crude material tank (not illustrated) or the like; a shutter mechanism 7 (FIG. 2) that is provided to the grain supplying tube 8 and selectively accepts or blocks the grains; a conical guide member 9 that spreads the grains received from the grain supplying tube 8 radially in the circumferential direction; an upper bearing part 10 arranged inside of the guide member 9; a flow rate adjusting apparatus 11 for adjusting the supply flow rate of the grains; a cover member 12 that houses the guide member 9, the upper bearing part 10, and the flow rate adjusting apparatus 11 therein; and a feeding spiral 13 that feeds the grains from the flow rate adjusting apparatus 11 to the grain grinding/polishing unit 3.

The shutter mechanism 7 includes: an opening/closing valve 15 provided to a supply port 14; and an opening/closing driving part 16 such as an air cylinder that is provided outside of the grain supplying tube 8 and drives opening/closing of the opening/closing valve 15.

The apex of the guide member 9 is arranged immediately below the grain supplying tube 8, and the grains that fall onto the guide member 9 flow down along the conical part thereof as they are, to be radially evenly spread.

Figure 3:
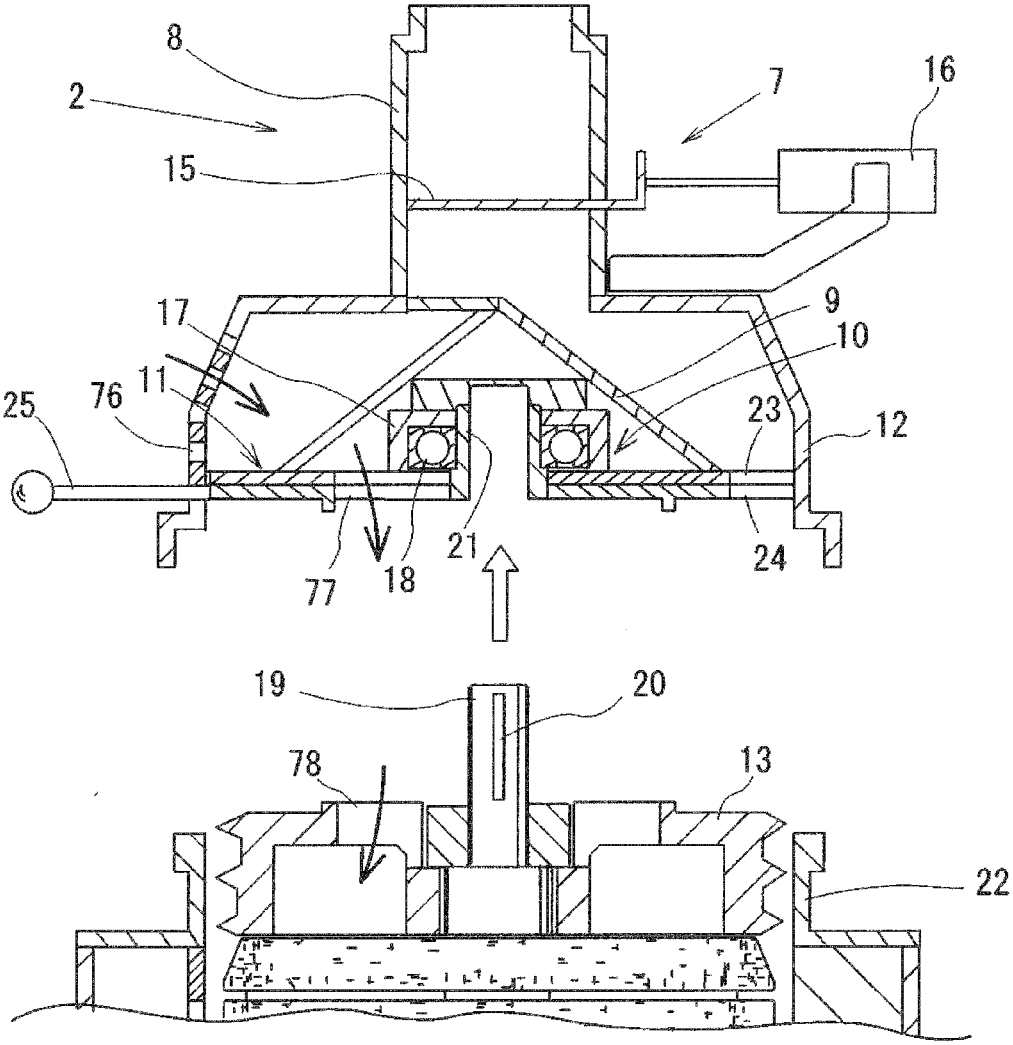
FIG. 3 is an enlarged cross sectional view for describing an upper portion of a grain supplying unit (first embodiment).

The upper bearing part 10 includes: a bearing cover 17; and a bearing 18 (FIG. 3) that is arranged in the bearing cover 17, and rotatably supports an upper part of a main shaft 19 that vertically erects. At this time, as illustrated in FIG. 3, a collar 21 fitted using a key 20 is provided between the main shaft 19 and the bearing 18, whereby the grain supplying unit 2 and the grain grinding/polishing unit 3 can be easily detached from each other. That is, if the cover member 12 of the grain supplying unit 2 is pulled upward out of a casing 22 of the grain grinding/polishing unit 3, the collar 21 is removed from the main shaft 19, whereby the grain supplying unit 2 and the grain grinding/polishing unit 3 are detached from each other. As a result, when grain cleaning rolls and the like provided to the grain grinding/polishing unit 3 are replaced, the maintenance work is extremely facilitated, and the working time is shortened.

The flow rate adjusting apparatus 11 includes: a fixed plate 23 including a plurality of opening parts; and a turnable plate 24 that includes a plurality of opening parts and is turned by an adjustment lever 25 (see FIG. 3). Then, the feeding spiral 13 axially supported by the main shaft 19 is rotatably arranged below the flow rate adjusting apparatus 11, in order to feed the grains to the grain grinding/polishing unit 3.

(Grain Grinding/Polishing Unit)

The grain grinding/polishing unit 3 includes, as main components, a grinding type grain cleaning roll member 84, a bran removing wire-mesh tube 28, and a bran removal cover 29.

Figure 6:
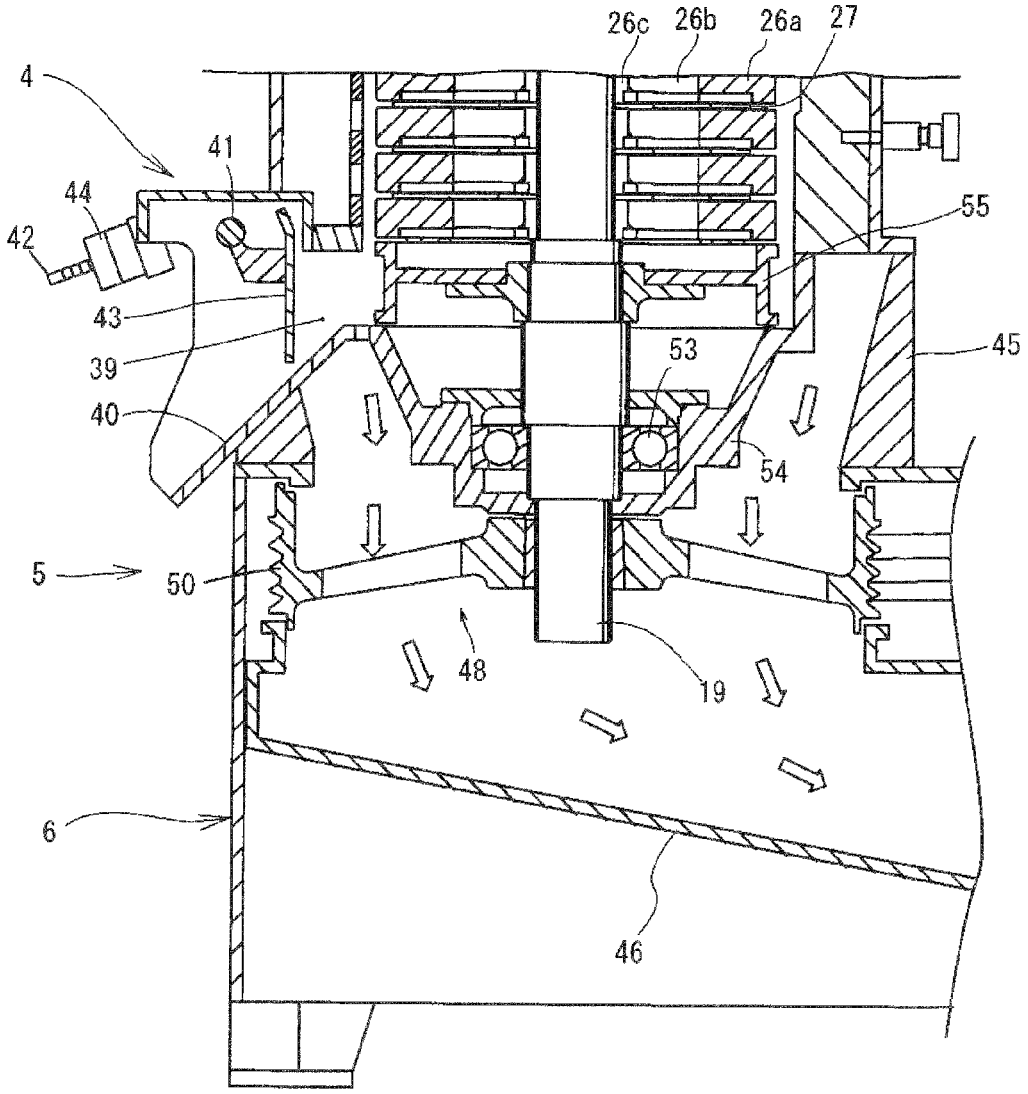
FIG. 6 is a front view illustrating a longitudinal cross section of a lower portion of the grinding type vertical grain polishing machine (first embodiment).

In the grinding type grain cleaning roll member 84, a plurality of grinding type grain cleaning rolls 26 attached to the main shaft 19 and spacers 27 (FIG. 4) respectively interposed between the plurality of grinding type grain cleaning rolls 26 are integrally incorporated. A cross section of each grinding type grain cleaning roll 26 is on a concentric circle, and abrasive grains of a grinding stone are embedded in the entire outer circumferential surface of the grinding type grain cleaning roll 26. A grinding part 26*a* (see FIG. 6) of each grinding type grain cleaning roll 26 is coupled to a boss part 26*c* with the intermediation of an arm part 26*b*. The spacers 27 are respectively interposed between the plurality of grinding type grain cleaning rolls 26, and space parts in which the spacers 27 do not exist serve as air jet ports 32 so as to face a grain cleaning chamber 30 (see FIG. 4)

The bran removing wire-mesh tube 28 is made of a porous wall part, and is erected with a slight gap in the circumferential direction of the grinding type grain cleaning roll member 84. Moreover, the bran removal cover 29 is further erected with a gap in the circumferential direction of the bran removing wire-mesh tube 28. Then, the grain cleaning chamber 30 is formed between the bran removing wire-mesh tube 28 and the grinding type grain cleaning rolls 26, and a bran removing chamber 31 is further formed between the bran removing wire-mesh tube 28 and the bran removal cover.

Figure 4:
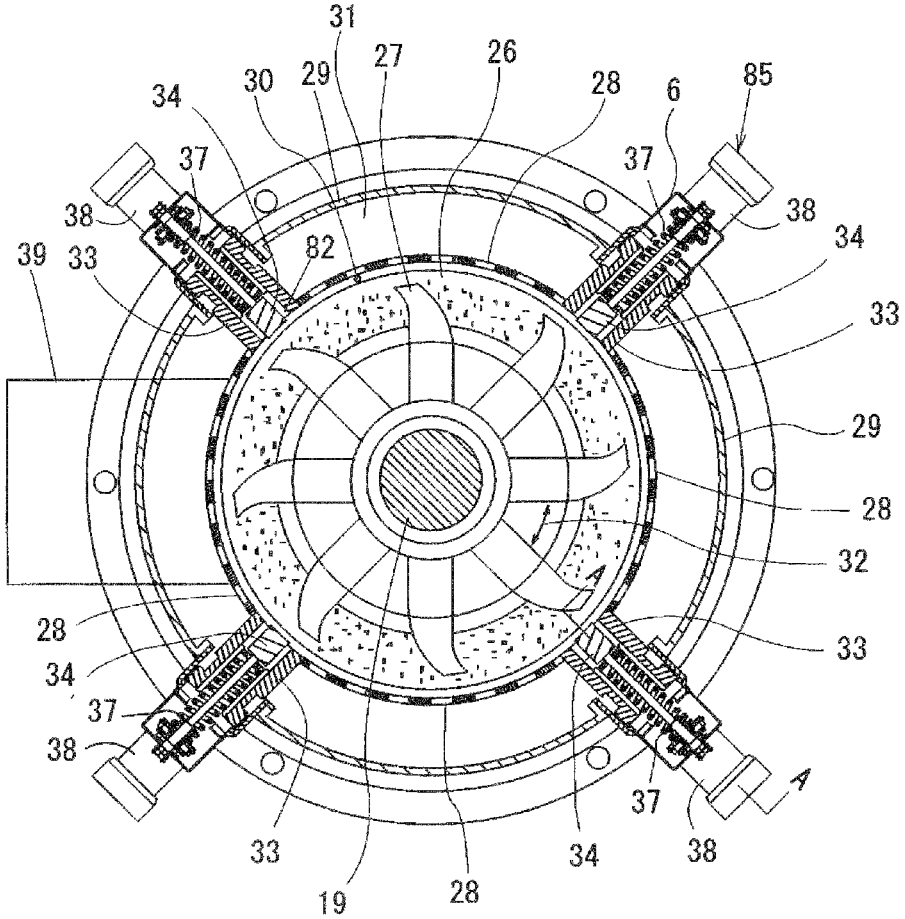
FIG. 4 is a cross sectional view of a grain grinding/polishing unit (first embodiment).

In the present embodiment, the bran removing wire-mesh tube 28 is formed so as to be vertically divided into four (see FIG. 4). Both side edges of the divided parts of the bran removing wire-mesh tube 28 are respectively fixed by four support pillars 33 that are erected with an interval from the circumferences of the grinding type grain cleaning rolls 26. Each support pillar 33 is part of a resistor apparatus 36. That is, the resistor apparatus 36 includes the support pillar 33, a resistor 34, an urging apparatus 85, and a pressure adjusting dial 38.

Figure 5:
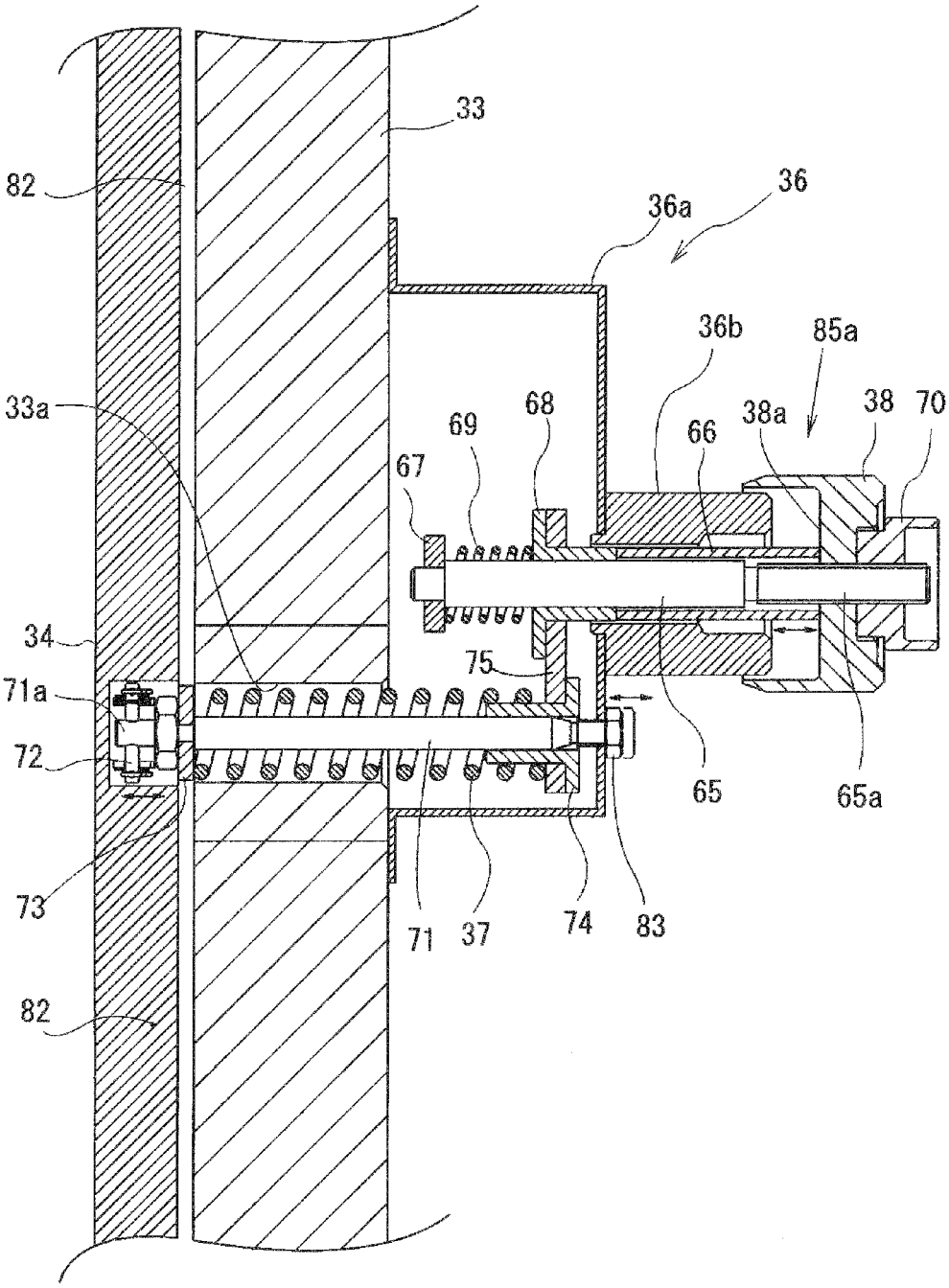
FIG. 5 is a cross sectional view illustrating an internal structure of an urging apparatus, which is taken along a line A-A in FIG. 4 (first embodiment).

Then, the resistor 34 that makes the space of the grain cleaning chamber 30 smaller is provided on the grain cleaning chamber 30 side of each support pillar 33 (FIGS. 2, 4, and 5). The resistor 34 has a cuboid shape that is formed so as to be vertically long in the axial direction of the main shaft 19. Both end parts of the resistor 34 in the longitudinal direction are supported by a plurality of support bolts 35 that are attached to upper and lower two portions of each support pillar 33. Further, the resistor 34 is slidably supported (can be protruded and retracted) in the horizontal direction by the resistor adjusting apparatus 36 attached to a middle part of each support pillar 33. Then, the resistor 34 is always urged toward the grain cleaning rolls 26 by a spring 37, and this urging force can be adjusted by a turn position of the pressure adjusting dial 38.

(Grain Discharging Unit)

The grain discharging unit 4 (FIGS. 1 and 6) that discharges the grains polished by the grain grinding/polishing unit 3 is arranged at the lower end of the grain cleaning chamber 30. The grain discharging unit 4 includes: a discharge port 39 formed by opening part of the bran removing wire-mesh tube 28; a discharged grain receiver 40 connected to the discharge port 39; a weight lever 42 fixedly attached to a shaft 41 bridged over the discharged grain receiver 40; a resistance plate 43 that is pivotally attached to one end of the weight lever 42 and closably faces the discharge port 39; and a weight 44 movably attached to another end of the weight lever 42.

(Bran Collecting Unit)

Figure 7:
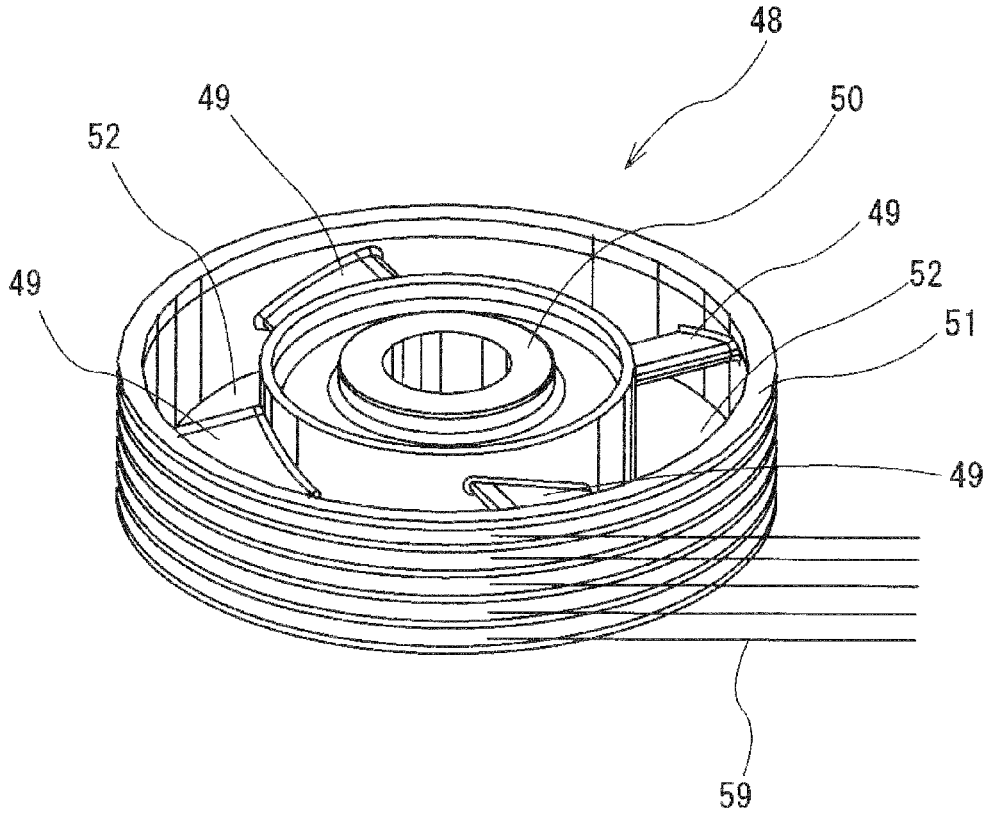
FIG. 7 is an enlarged perspective view of a pulley also provided with a fan function (first embodiment).

The bran collecting unit 5 (FIGS. 1 and 6) that collects the bran that is separated from the cleaned grains by the grain grinding/polishing unit 3 is arranged below the grain discharging unit 4. The bran collecting unit 5 includes: a bran discharging tube 45 communicated with a lower end part of the bran removing chamber 31; and a bran discharging pipe 46 that sends the bran from the bran discharging tube 45 to an external bran suctioning fan 47. Then, a pulley 48 provided with a function of a fan that generates bran removing wind through rotation is arranged in a communication part between the bran discharging tube 45 and the bran discharging pipe 46. As illustrated in FIG. 7, when the pulley 48 rotates, downward bran removing wind is generated by feather-shaped arm parts 49, and the bran passes through space parts 52 surrounded by a boss part 50, a rim part 51, and the arm parts 49, so that the bran discharge is promoted from the bran discharging tube 45 toward the bran discharging pipe 46.

A lower bearing part 53 for supporting the main shaft 19 is arranged in an upper part of the pulley 48. The lower bearing part 53 is housed in a bearing case 54 fixedly provided to the casing 22, and the main shaft 19 can be rotated by the rotation of the pulley 48. Reference sign 55 denotes a grain discharging roll axially supported by the main shaft 19. As described above, the grain grinding/polishing unit 3 is formed on the grain discharging roll 55 by stacking the plurality of grinding type grain cleaning rolls 26 in a multiple-stage manner.

[Resistor Apparatus]

An internal mechanism of the resistor apparatus 36 is described with reference to FIG. 5. A cover member 36*a* of the resistor apparatus 36 is fixedly provided to each support pillar 33 that fixes the bran removing wire-mesh tube 28, and a main body 36*b* of the resistor apparatus 36 is fixedly provided so as to protrude outward from the cover member 36*a*. The resistor apparatus 36 includes the urging apparatus 85. The urging apparatus 85 includes the main body 36*b*, the spring 37, the pressure adjusting dial 38, a screw shaft 65, a first spring 69, and a sliding shaft 71.

Figure 8:
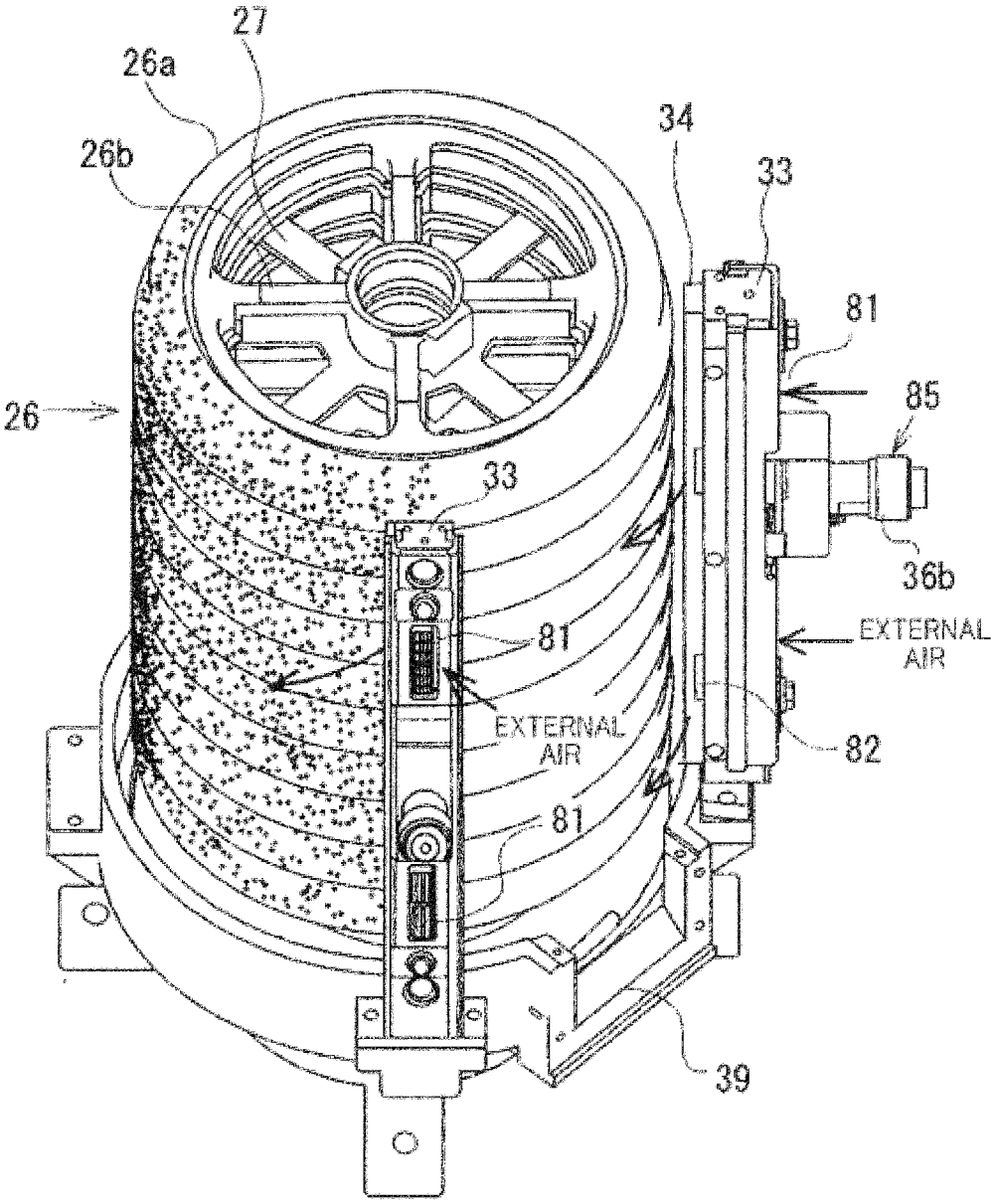
FIG. 8 is a perspective view illustrating the grain grinding/polishing unit from which a bran removing wire-mesh tube is removed (first embodiment).

A threaded hole (not illustrated) is pierced through the main body 36*b*, the screw shaft 65 is inserted through the threaded hole, and a sliding tube 66 is fitted into the gap between the screw shaft 65 and the main body 36*b*. Then, a leading end part of the screw shaft 65 is provided: a fixed spring-receiver base 67 fixedly provided to the screw shaft 65; a movable spring-receiver base 68 slidable with respect to the screw shaft 65; and the first spring 69 fitted between the fixed spring-receiver base 67 and the movable spring-receiver base 68 of the screw shaft 65. The movable spring-receiver base 68 is slidable in the horizontal direction during reception of the elastic force of the first spring 69. Meanwhile, a male screw part 65*a* is formed on a back end side of the screw shaft 65, and the pressure adjusting dial 38 that slides the sliding tube 66 in the left-right direction of FIG. 8 is screwed with the male screw part 65*a*. Reference sign 70 denotes a lock part for fixing the pressure adjusting dial 38.

Further, the sliding shaft 71 parallel to the screw shaft 65 is inserted through the cover member 36*a* below the screw shaft 65, and the leading end of the sliding shaft 71 is inserted through a central opening part 33*a* of the support pillar 33. Then, a leading end part 71*a* of the sliding shaft 71 is coupled to the resistor 34 with the intermediation of the joint part 72. The sliding shaft 71 is provided with: a second fixed spring-receiver base 73 fixedly provided to the sliding shaft 71; a second movable spring-receiver base 74 slidable with respect to the sliding shaft 71; and the spring 37 fitted between the second fixed spring-receiver base 73 and the second movable spring-receiver base 74. Then, a coupling member 75 for moving the second movable spring-receiver base 74 along with movement of the movable spring-receiver base 68 by the same amount of movement is bridged between the second movable spring-receiver base 74 and the movable spring-receiver base 68. Note that reference sign 83 denotes a fine adjustment nut that can finely adjust the size of the gap between the grinding type grain cleaning rolls 26 and the resistor 34.

(Main Body Base Unit)

A motor base 56 is provided lateral to the main body base unit 6 below the machine body. A driving motor 57 is fixed to the motor base 56, and a V belt 59 is interlocked and coupled between a motor pulley 58 and the pulley 48, whereby rotation of the driving motor 57 can be transmitted to the main shaft 19. Moreover, the main body base unit 6 is provided with a moving apparatus 60 that moves the motor base 56 in the horizontal direction relative to the main body base unit 6 and adjusts the axial center distance between the motor pulley 58 and the pulley 48.

The moving apparatus 60 includes: a hook part 61 with which a screw for moving the motor base 56 in the horizontal direction is engaged; a male screw part 62 having a threaded outer circumference; and a female screw part 63 in which an internal screw engaged with the male screw part 62 is fixedly provided on the main body base unit 6 side. Then, a leading end part 62*a* of the male screw part 62 is fixed to the hook part 61, while the vicinity of a head part of the male screw part 62 is screwed with the female screw part 63. As a result, even if the length of the V belt 59 wound around between the motor pulley 58 and the pulley 48 changes, if the male screw part 62 is rotated by an amount corresponding to the change in length, the main body base unit 6 and the motor base 56 are moved relative to each other, and hence the V belt 59 can be kept at an appropriate tension without loosening.

The bran discharging pipe 46 is laterally provided inside of the main body base unit 6 so as not to interfere with the pulley 48, the motor pulley 58, and the V belt 59.

(Actuation)

First, the driving motor 57 serving as a driving source is actuated, and the pulley 48, the main shaft 19, and the grinding type grain cleaning rolls 26 are rotated. In this state, the opening/closing valve 15 is opened by the opening/closing driving part 16, whereby the grains stored in the crude material tank or the like drop downward from the supply port 14. The grains that have dropped flow downward while being evenly spread in the circumferential direction by the guide member 9 located therebelow, and are fed to the feeding spiral 13 while being adjusted to an appropriate supply flow rate by the adjustment lever 25.

In the feeding spiral 13, the grains are sequentially fed to the grain cleaning chamber 30. In the grain cleaning chamber 30, the grains are subjected to active flow actions (revolution and rotation) under a low pressure while coming into contact with the circumferential surfaces of the grinding type grain cleaning rolls 26, whereby the surface layers of the grains are ground. At this time, each resistor 34 that makes the space of the grain cleaning chamber 30 smaller is urged toward the grain cleaning rolls 26 by each spring 37. Meanwhile, if the pressure is becoming so high that broken grains may occur in the grain cleaning chamber 30, the resistor 34 is pushed by the pressing force of the grains against the elastic force of the spring 37, and move in a direction farther from the grain cleaning rolls 26. As a result, the grain cleaning chamber 30 is adjusted to an appropriate pressure that is originally set, and a risk of the occurrence of such broken grains can be automatically avoided.

Then, in the grain discharging unit 4, the grains open the resistance plate 43 against the holding force of the resistance plate 43 that receives the force of the weight 44, to be thereby discharged and taken out of the machine through the discharged grain receiver 40. Moreover, in the bran collecting unit 5, the pulley 48 axially supported by the main shaft 19 is configured as a pulley also provided with a fan function. Hence, the bran in the bran removing chamber 31 is evenly suctioned by the bran removing wind generated through rotation of the pulley 48, and is extremely efficiently discharged toward the bran discharging pipe 46.

In each resistor apparatus 36, in the case where the resistance pressure (the force of suppression in movement of the grains) of the resistor 34 is made higher, the pressure adjusting dial 38 is turned in a clockwise direction. That is, if the pressure adjusting dial 38 is screwed into the male screw part 65*a*, the sliding tube 66 that abuts against a bottom surface 38*a* is moved depending on the screw-in amount in the left direction of FIG. 8, and the movable spring-receiver base 68 that abuts against the leading end of the sliding tube 66 is moved in the left direction against the urging force of the first spring 69. Then, the change in position of the movable spring-receiver base 68 is transmitted to the second movable spring-receiver base 74 by the coupling member 75. As a result, the second movable spring-receiver base 74 moves in the left direction to compress the spring 37, so that the elastic force can be made stronger. Conversely, in the case where the resistance pressure of the resistor 34 is made lower, the pressure adjusting dial 38 is turned in a counterclockwise direction. As a result, the second movable spring-receiver base 74 is moved in the right direction to expand the spring 37, so that the elastic force can be made weaker.

[External Air Take-in Structure]

An external air take-in structure provided to the grain supplying unit 2 and the grain grinding/polishing unit 3 is described. A plurality of external air take-in ports 76 are provided on the peripheral wall of the cover member 12 of the grain supplying unit 2 (FIG. 1, FIG. 3), and an opening 77 is formed in the flow rate adjusting apparatus 11. Further, a ventilation port 78 that circulates the taken-in external air to the inside of the grain grinding/polishing unit 3 is provided on the upper surface of the feeding spiral 13.

Moreover, a plurality of external air take-in ports 80 (FIG. 1) are provided on the peripheral wall of a support pillar cover 79 (FIG. 1) that covers each support pillar 33 of the grain grinding/polishing unit 3. That is, as illustrated in FIG. 8, each support pillar 33 is provided with external air take-in ports 81 that take the external air into the grain grinding/polishing unit 3, and the taken-in external air is circulated inside of the grain grinding/polishing unit 3, whereby the bran generated through grain polishing can be promptly sent from the grain cleaning chamber 30 to the bran removing chamber 31.

According to this configuration, when the grains flow down from the grain supplying tube 8 to the guide member 9 in the grain supplying unit 2, the external air is taken in from the external air take-in ports 76, passes through the opening 77, and flows from the ventilation port 78 to the inside of the feeding spiral 13. Then, the external air is fed from the inside of the feeding spiral 13 toward the inside of the grinding type grain cleaning rolls 26, and is jetted from the air jet ports 32 of the grinding type grain cleaning rolls 26 toward the grain cleaning chamber 30. The bran passes through the bran removing wire-mesh tube 28 due to the wind jetted toward the grain cleaning chamber 30, and reaches the bran removing chamber 31.

Meanwhile, as illustrated in FIG. 8, also in the grain grinding/polishing unit 3, the external air is taken in from the external air take-in ports 81 provided to each support pillar 33, and is jetted from air jet ports 82 toward the grain cleaning chamber 30. The air jet ports 82 are formed in the gap between each support pillar 33 and a surface of each resistor 34, the surface being on a downstream side with respect to movement of the grains. The gap between the downstream surface and the support pillar 33 is a region through which the grains do not pass or a region through which few grains pass. Moreover, if the air jet ports 82 are formed, the grains are prevented from being caught or biting into, and the resistor 34 smoothly turns. Then, in cooperation with the wind that is jetted from the air jet ports 32 to the grain cleaning chamber 30, the wind that is jetted from the air jet ports 82 to the grain cleaning chamber 30 acts so as to reliably send the bran in the grain cleaning chamber 30 to the bran removing chamber 31.

As has been described above, each support pillar 33 is provided with the elongated resistor 34 that is long in the vertical direction and imparts a resistance to movement of the grains in the circumferential direction the grinding type grain cleaning rolls 26. The resistor 34 is protruded toward the inside of the grain cleaning chamber 30 by the elastic member 37 with an urging force that is set in advance, and the resistor 34 is provided so as to be movable in the radial direction to a position farther from the grain cleaning chamber 30 in accordance with the pressing force of the moving grains. The above-mentioned urging force acts in the following manner. That is, along with rotation of the grinding type grain cleaning roll member 84, the grains in the grain cleaning chamber 30 are subjected to active flow actions (revolution and rotation) under a low pressure while coming into contact with the circumferential surfaces of the grinding type grain cleaning rolls 26, whereby the surface layers of the grains are ground. Meanwhile, at a given moment, if the pressure is becoming so high that broken grains may occur in the grain cleaning chamber 30, the resistor 34 is automatically moved by the pressing force of the grains against the elastic force of the spring 37 (elastic member) in a direction farther from the grain cleaning rolls 26. As a result, at the time of grain polishing, an operator does not need to manually adjust the amount of protrusion of the resistor 34 (the degree of suppression in movement of the grains).

[Second Embodiment]

FIGS. 9 to 12 each illustrate a main part of a second embodiment. The overall configuration of the grinding type vertical grain polishing machine 1 and the configurations of the grain supplying unit, the grain grinding/polishing unit, the grain discharging unit, the bran collecting unit, and the main body base unit in the present embodiment are the same as those in the first embodiment. The same reference signs are used therefor, and the description in the first embodiment is applied thereto.

Compared with the first embodiment, the second embodiment has characteristics in the resistor apparatus 36 and the external air take-in structure.

[Resistor Apparatus]

Figure 10:
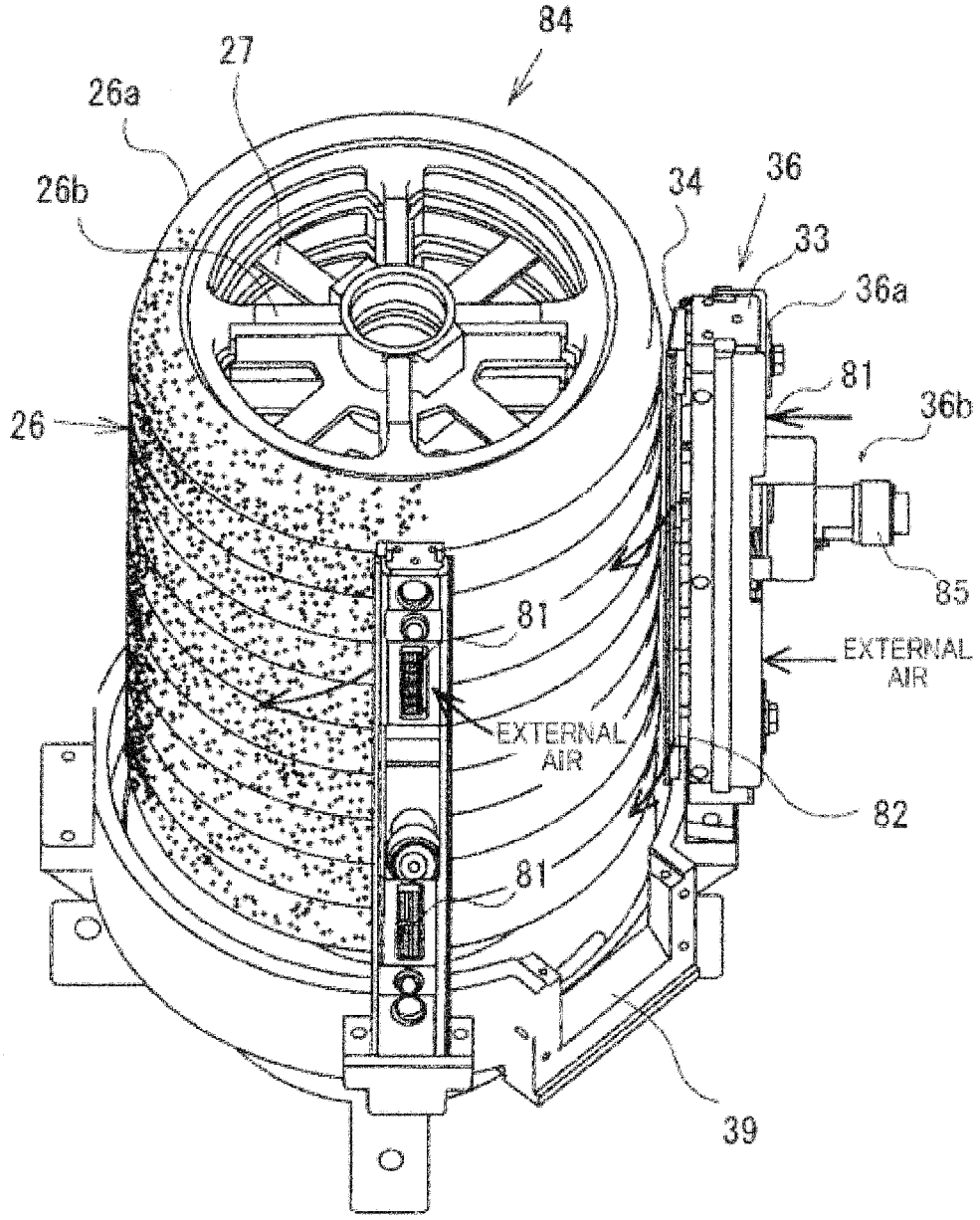
FIG. 10 is a perspective view illustrating the grain grinding/polishing unit from which a bran removing wire-mesh tube is removed (second embodiment).

The resistor apparatus 36 is long in the axial direction of the main shaft 19, and extends over the substantially entire length of the grinding type grain cleaning roll member 84 (FIG. 10).

Figure 11:
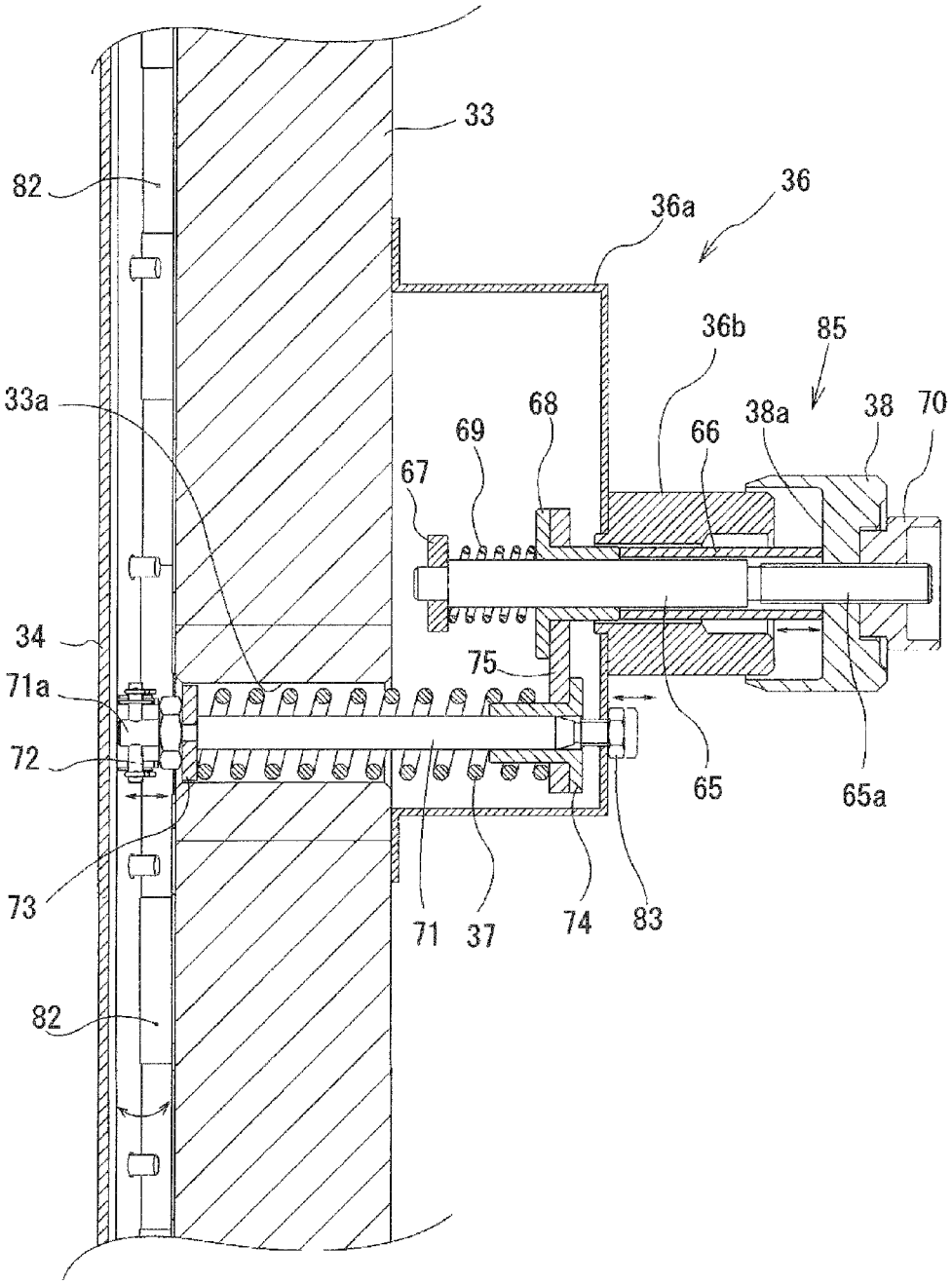
FIG. 11 is a cross sectional view illustrating an internal structure of an urging apparatus, which is taken along a line A-A in FIG. 9 (second embodiment).
Figure 12:
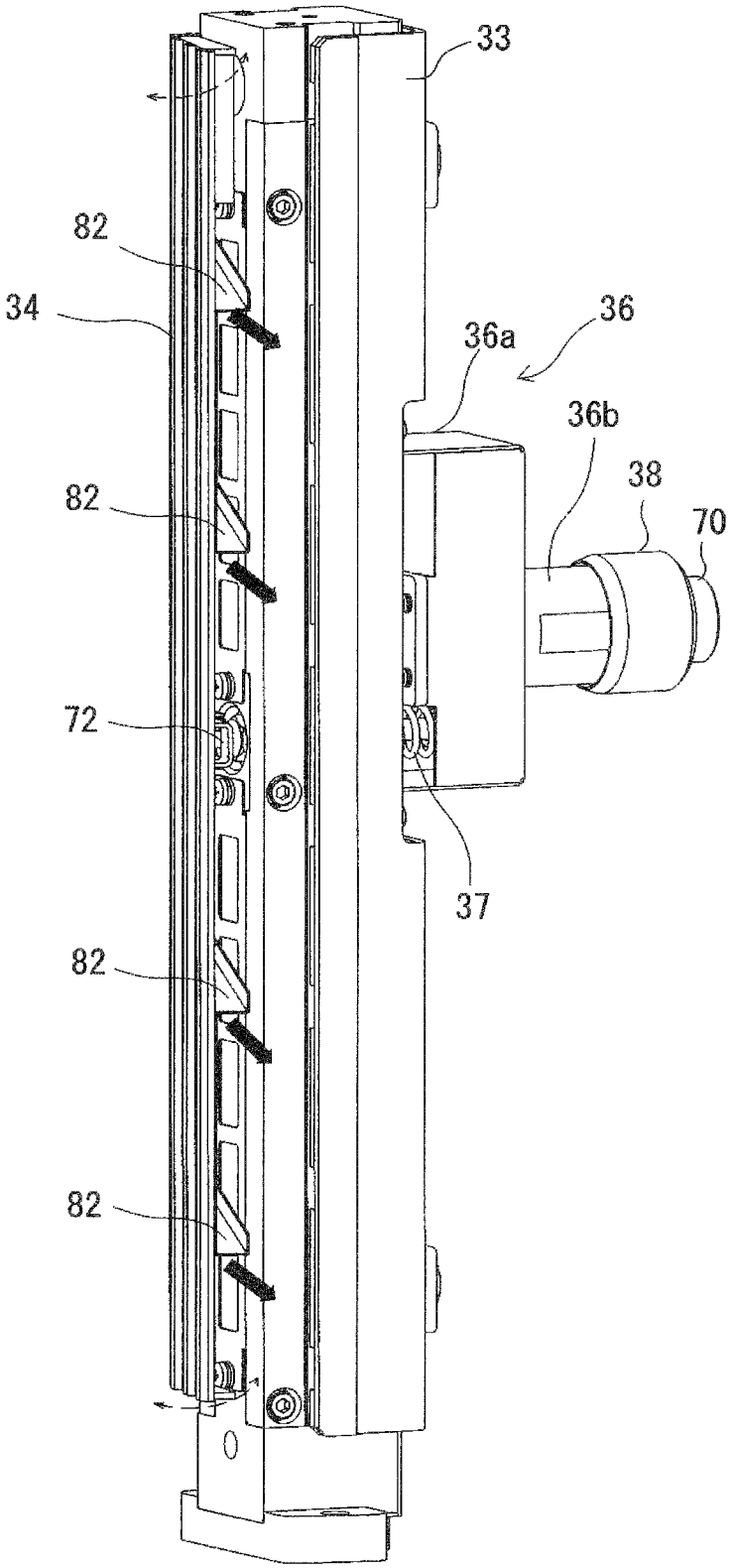
FIG. 12 is a perspective view of a resistor apparatus, also illustrating blowing out from air jet ports.

An internal mechanism of the resistor apparatus 36 is described with reference to FIGS. 10 and 11.

The cover member 36*a* of the resistor apparatus 36 is fixedly provided to each support pillar 33 that fixes the bran removing wire-mesh tube 28, and the main body 36*b* of the resistor apparatus 36 is fixedly provided so as to protrude outward from the cover member 36*a*. The resistor apparatus 36 includes the urging apparatus 85. The urging apparatus 85 (FIG. 11) includes the main body 36*b*, the spring 37, the pressure adjusting dial 38, the screw shaft 65, the first spring 69, and the sliding shaft 71.

The threaded hole (not illustrated) is pierced through the main body 36*b*, the screw shaft 65 is inserted through the threaded hole, and the sliding tube 66 is fitted into the gap between the screw shaft 65 and the main body 36*b*. Then, the leading end part of the screw shaft 65 is provided: the fixed spring-receiver base 67 fixedly provided to the screw shaft 65; the movable spring-receiver base 68 slidable with respect to the screw shaft 65; and the first spring 69 fitted between the fixed spring-receiver base 67 and the movable spring-receiver base 68 of the screw shaft 65. The movable spring-receiver base 68 is slidable in the horizontal direction during reception of the elastic force of the first spring 69. Meanwhile, the male screw part 65*a* is formed on the back end side of the screw shaft 65, and the pressure adjusting dial 38 that slides the sliding tube 66 in the left-right direction of FIG. 11 is screwed with the male screw part 65*a*. Reference sign 70 denotes the lock part for fixing the pressure adjusting dial 38.

Figure 9:
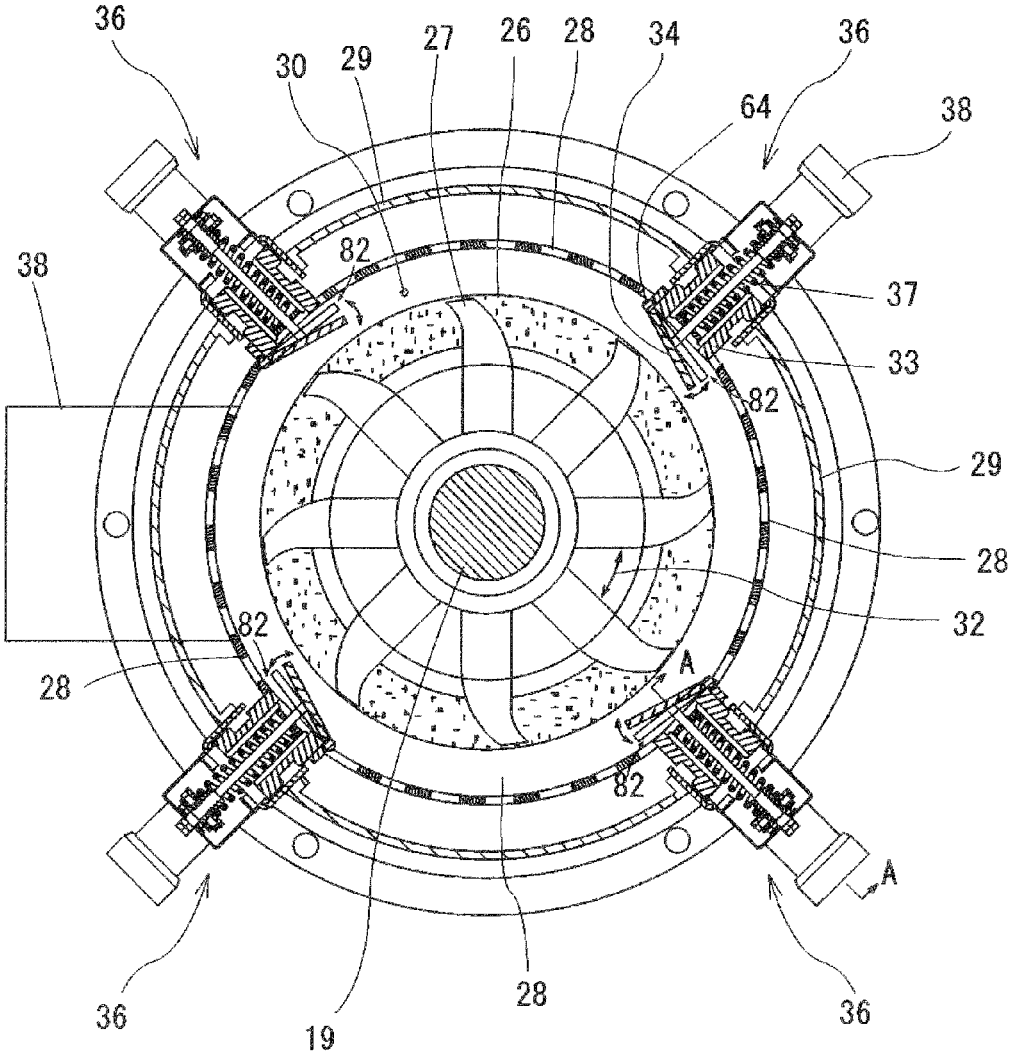
FIG. 9 is a cross sectional view of a grain grinding/polishing unit (second embodiment).

Further, the sliding shaft 71 parallel to the screw shaft 65 is inserted through the cover member 36*a* below the screw shaft 65, and the leading end of the sliding shaft 71 is inserted through the central opening part 33*a* of the support. pillar 33. Then, the leading end part 71*a* of the sliding shaft 71 is coupled to the resistor 34 with the intermediation of the joint part 72. The resistor 34 is an elongated plate that is formed so as to be vertically long and turnable about a hinge 64 (FIG. 9). The resistor 34 is formed such that one end edge of the plate and the support pillar 33 are supported by the hinge 64 and that another end edge of the plate is movable (turnable) about the hinge 64 by the urging apparatus 85.

Further, similarly to the case of the first embodiment, the leading end part of the sliding shaft 71 is provided with: the second fixed spring-receiver base 73 fixedly provided to the sliding shaft 71; the second movable spring-receiver base 74 slidable with respect to the sliding shaft 71; and the spring 37 fitted between the second fixed spring-receiver base 73 and the second movable spring-receiver base 74. Then, the coupling member 75 for moving the second movable spring-receiver base 74 along with movement of the movable spring-receiver base 68 by the same amount of movement is bridged between the second movable spring-receiver base 74 and the movable spring-receiver base 68. Note that reference sign 83 denotes the fine adjustment nut that can finely adjust the size of the gap between the grinding type grain cleaning rolls 26 and the resistor 34.

As described above, in the second embodiment, the resistor 34 is located in the space of the grain cleaning chamber 30, and suppresses movement of the grains moving in this space at a posture at which the resistor 34 is turned about the hinge 64. This turned posture is an inclined posture at which the hinge side is upstream and another end side is downstream with respect to the flow (movement) of the grains due to rotation of the grinding type grain cleaning roll member 84. Then, the resistor 34 is pushed and urged toward the grain cleaning rolls 26 by the spring 37 of the urging apparatus 85, and this urging force can be adjusted by the turn position of the pressure adjusting dial 38.

Similarly to the case of the first embodiment, the urging force of the spring 37 normally acts in the following manner. That is, along with rotation of the grinding type grain cleaning roll member 84; the grains in the grain cleaning chamber 30 are subjected to active flow actions under a low pressure while coming into contact with the circumferential surfaces of the grinding type grain cleaning rolls 26, whereby the surface layers of the grains are ground. Meanwhile, for some reason, under such a high pressure that broken grains may occur in the grain cleaning chamber 30, the resistor 34 is turned about the hinge 64 by the pressing force of the grains against the elastic force of the spring 37 so as to avoid outward, and automatically moves in a direction farther from the grain cleaning rolls 26.

Accordingly, similarly to the case of the first embodiment, at the time of grain polishing, an operator does not need to manually adjust the amount of protrusion of the resistor 34 (the degree of suppression in movement of the grains).

Note that, also in the second embodiment, the plurality of external air take-in ports 76 are provided on the peripheral wall of the cover member 12 of the grain supplying unit 2, the plurality of external air take-in ports 80 are provided on the peripheral wall of the support pillar cover 79 (FIG. 1) that covers each support pillar 33 of the grain grinding/polishing unit 3, and the external air taken in from these ports is circulated inside of the grain grinding/polishing unit 3, whereby the bran generated through grain polishing can be promptly sent from the grain cleaning chamber 30 to the bran removing chamber 31.

In this case, the external air taken in from the external air take-in ports 81 of each support pillar 33 is jetted from the air jet ports 82 toward the grain cleaning chamber 30. The air jet ports 82 are formed in the gap between each support pillar 33 and a surface of each resistor 34, the surface being on a downstream side with respect to movement of the grains. Particularly in the case of the second embodiment, the resistor 34 is a plate, and is in such an inclined state that the one end edge on an upstream side with respect to the movement of the grains is supported by the hinge 64 and that the another end edge approaches the grinding type grain cleaning roll member 84. Hence, a space without grains can be easily made on the downstream side of the resistor 34. Accordingly, the air can be efficiently jetted from the air jet ports 82 provided in this space, without being hindered by the grains.

[Third Embodiment]

Figure 13:
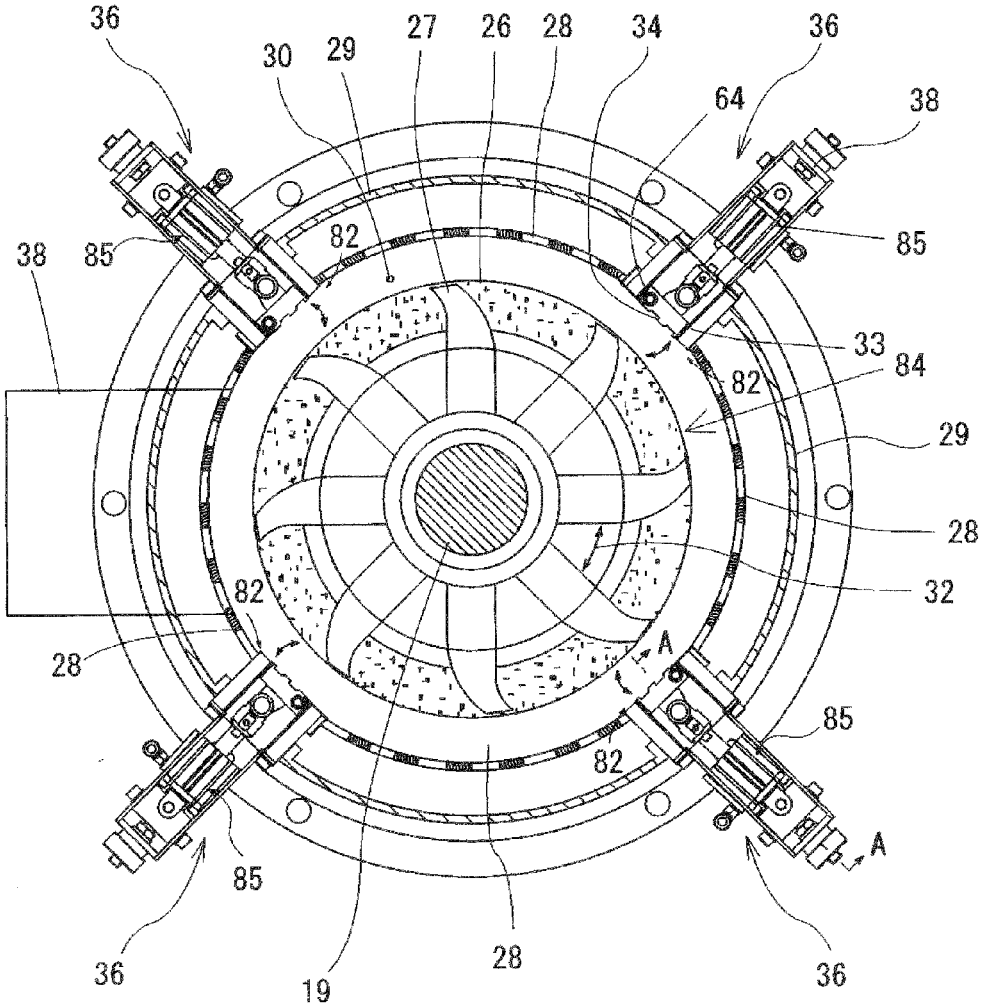
FIG. 13 is a cross sectional view of a grain grinding/polishing unit (third embodiment).
Figure 14:
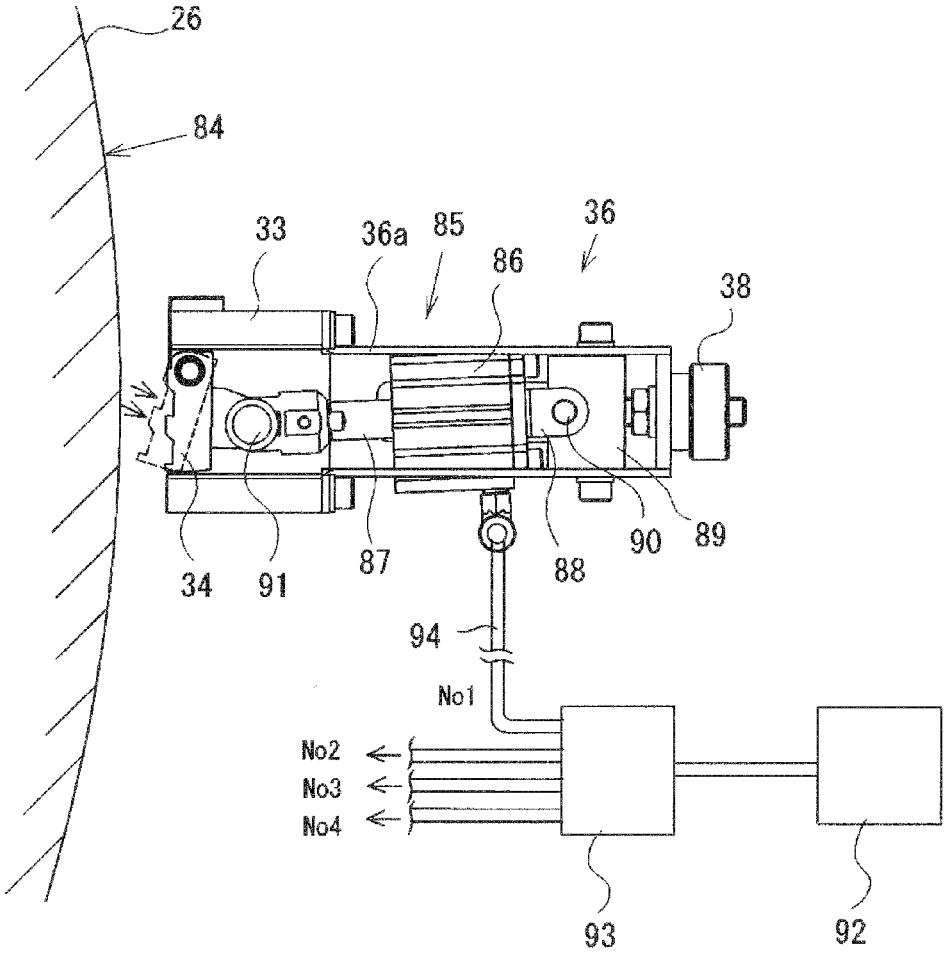
FIG. 14 is a cross sectional view illustrating an internal structure of an urging apparatus, which is taken along a line A-A in FIG. 13 (third embodiment).
Figure 15:
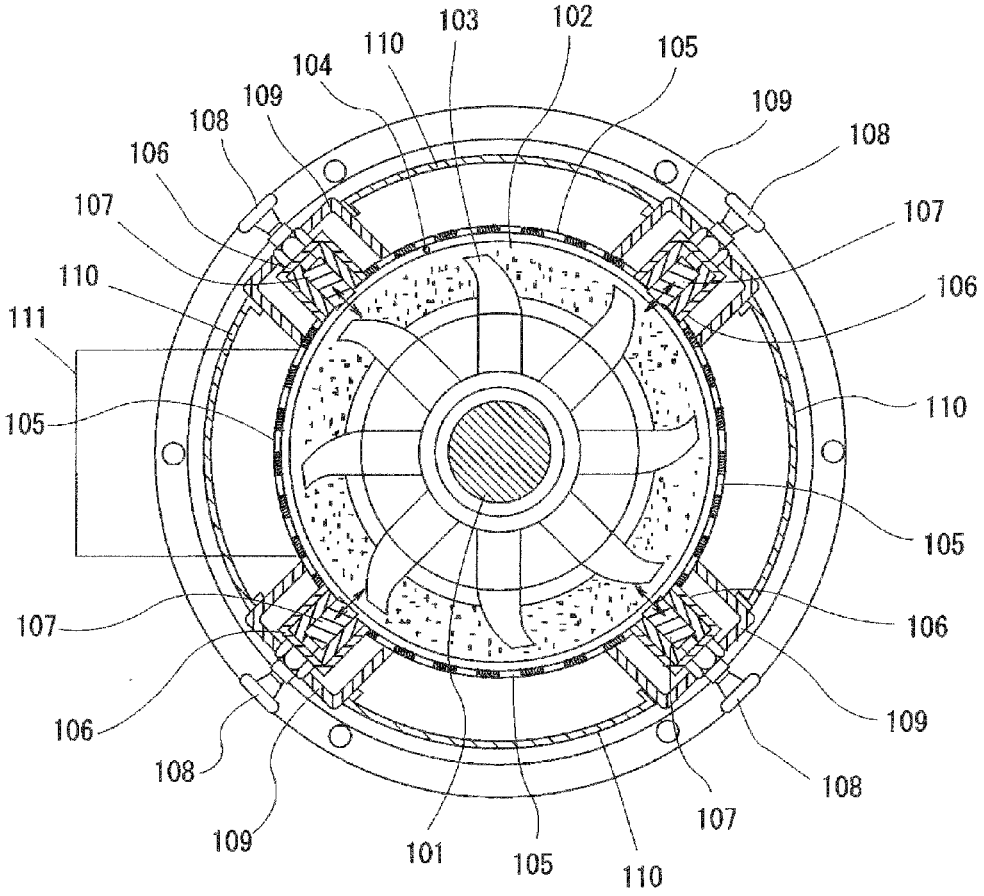
FIG. 15 is a cross sectional view of a grain grinding/polishing unit (conventional example).

FIGS. 13 and 14 each illustrate a main part of a third embodiment. The overall configuration of the grinding type vertical grain polishing machine 1 and the configurations of the grain supplying unit, the grain grinding/polishing unit, the grain discharging unit, the bran collecting unit, and the main body base unit in the present embodiment are the same as those in the first embodiment. The same reference signs are used therefor, and the description in the first embodiment is applied thereto.

Compared with the second embodiment, the third embodiment has characteristics in the resistor apparatus 36 and the external air take-in structure, in which urging means of the urging apparatus 85 is an air pressure.

[Resistor Apparatus]

Similarly to the case of the first embodiment, the resistor apparatus 36 is long in the axial direction of the main shaft 19, and extends over the substantially entire length of the grinding type grain cleaning roll member 84.

An internal mechanism of the resistor apparatus 36 is described with reference to FIGS. 13 and 14.

The cover member 36*a* of the resistor apparatus 36 is fixedly provided to each support pillar 33 that fixes the bran removing wire-mesh tube 28, and the pressure adjusting apparatus 38 is provided so as to protrude outward from the cover member 36*a*.

The resistor apparatus 36 includes the urging apparatus 85. The urging apparatus 85 is an air actuator, and includes an air cylinder 86, a movable rod 87, and the pressure adjusting apparatus 38. The air cylinder 86 includes an attachment part 88 at one end thereof that is turnably attached to a coupling block 89 of the pressure adjusting apparatus 38 by a shaft 90. Another end of the air cylinder 86 is turnably coupled to the resistor 34 by a free joint structure 91. One end of the resistor 34 is turnably supported by a shaft 92 on the support pillar 33 side, and the resistor 34 is turned about the shaft 92 by protruding and retracting the movable rod 87, whereby the degree of protrusion (inclination angle) of the resistor 34 with respect to the grinding type grain cleaning rolls 26 can be adjusted.

A branched pipe No. 1 is connected to the air cylinder 86, and an air pressure is supplied to the inside of the air cylinder 86 from a compressor 92 via a regulator 93. This air pressure can be adjusted by the regulator 93. Branched pipes No. 1 to No. 4 are connected to the regulator 93, and are respectively connected to the air cylinders 86 of the resistor apparatuses 36 the number of which is four in the present embodiment. Accordingly, the resistor 34 of each resistor apparatus 36 receives the air pressure to turn about the hinge 64, and thus suppresses movement of the grains.

Similarly to the case of the first embodiment, the urging force of the air pressure in the air cylinder normally acts in the following manner. That is, along with rotation of the grinding type grain cleaning roll member 84, the grains in the grain cleaning chamber 30 are subjected to active flow actions under a low pressure while coming into contact with the circumferential surfaces of the grinding type grain cleaning rolls 26, whereby the surface layers of the grains are ground. Meanwhile, for some reason, under such a high pressure that broken grains may occur in the grain cleaning chamber 30, the movable rod 87 is pushed by the pressing force of the grains against the air pressure with the intermediation of the resistor 34. Consequently, the pressure inside of the air cylinder increases, but this change in pressure is adjusted by the regulator 93, so that excessive suppression in movement of the grains is prevented.

Accordingly, similarly to the case of the first embodiment, at the time of grain polishing, an operator does not need to manually adjust the amount of protrusion of the resistor 34 (the degree of suppression in movement of the grains). At this time, because the urging is achieved by the air pressure, if the member that imparts the urging is configured as an air actuator in the urging apparatus, the resistance of the resistor to the movement of the grains can be more precisely adjusted or actively adjusted, in combination with a pressure detecting sensor and the like. Moreover, if an air damper is used, the responsiveness of resistance adjustment is smoother, and the movement of the grains is less likely to be disturbed, compared with the case of the elastic member.

Note that, also in the third embodiment, the plurality of external air take-in ports 76 are provided on the peripheral wall of the cover member 12 of the grain supplying unit 2, the plurality of external air take-in ports 80 are provided on the peripheral wall of the support pillar cover 79 (FIG. 1) that covers each support pillar 33 of the grain grinding/polishing unit 3, and the external air taken in from these ports is circulated inside of the grain grinding/polishing unit 3, whereby the bran generated through grain polishing can be promptly sent from the grain cleaning chamber 30 to the bran removing chamber 31.

INDUSTRIAL APPLICABILITY

The present invention can be applied to a vertical or horizontal grain polishing machine.

REFERENCE NUMERALS

1 grain polishing machine
2 grain supplying unit
3 grain grinding/polishing unit
4 grain discharging unit
5 bran collecting unit
6 main body base unit
7 shutter mechanism
8 grain supplying tube
9 guide member
10 upper bearing part
11 flow rate adjusting apparatus
12 cover member
13 feeding spiral
14 supply port
15 opening/closing valve
16 opening/closing driving part
17 bearing cover
18 bearing
19 main shaft

20 key
21 collar
22 casing
23 fixed plate
24 turnable plate
25 adjustment lever
26 grinding type grain cleaning roll
27 spacer
28 bran removing wire-mesh tube
29 bran removal cover
30 grain cleaning chamber
31 bran removing chamber
32 air jet port
33 support pillar
34 resistor
35 support bolt
36 resistor apparatus
37 spring
38 pressure adjusting dial
39 discharge port
40 discharged grain receiver
41 shaft
42 weight lever
43 resistance plate
44 weight
45 bran discharging tube
46 bran discharging pipe
47 bran suctioning fan
48 pulley
49 arm part
50 boss part
51 rim part
52 space part
53 lower bearing part
54 bearing case
55 grain discharging roll
56 motor base
57 driving motor
58 motor pulley
59 V belt
60 moving apparatus
61 hook part
62 male screw part
63 female screw part
64 hinge (pivot point)
65 screw shaft
66 sliding tube
67 fixed spring-receiver base
68 movable spring-receiver base
69 first spring
70 lock part
71 sliding shaft
72 joint part
73 second fixed spring-receiver base
74 second movable spring-receiver base
75 coupling member
76 external air take-in port
77 opening
78 ventilation port
79 support pillar cover
80 external air take-in port
81 external air take-in port
82 air jet port
83 fine adjustment nut
84 grinding type grain cleaning roll member
85 urging apparatus
86 air cylinder
87 movable rod
88 attachment part
89 coupling block
90 shaft
91 free joint
92 compressor
93 regulator

The invention claimed is:

1. A grinding type vertical grain polishing machine comprising:

a bran removing wire-mesh tube erected in a top-bottom direction;

a main shaft rotatably provided inside of the bran removing wire-mesh tube;

a grinding type grain cleaning roll member integrally including multiple grinding type grain cleaning rolls axially supported by the main shaft;

a grain cleaning chamber formed between the bran removing wire-mesh tube and the grinding type grain cleaning roll member; and a bran removing chamber and a resistor apparatus each formed on an outer circumferential side of the bran removing wire-mesh tube, wherein the resistor apparatus includes: a plurality of support pillars erected around the bran removing wire-mesh tube; and a resistor and an urging apparatus provided for each of the support pillars, the resistor has a leading end surface that approaches an outer circumferential surface of the grinding type grain cleaning roll member inside of the grain cleaning chamber, to thereby impart a resistance for suppressing movement to grains moving along with rotation of the grinding type grain cleaning roll member, a position of the leading end surface is adjustable so as to be closer to or farther from the outer circumferential surface of the grinding type grain cleaning roll member in a radial direction of the grinding type grain cleaning roll member, the resistor is always urged by the urging apparatus toward the grinding type grain cleaning roll member, and when pressing force of the grains exceeds the urging by the urging apparatus, the resistor is retracted from the grinding type grain cleaning roll member against the urging, wherein the urging apparatus is an air actuator, and includes an air cylinder and a pressure adjusting apparatus, wherein one end of the air cylinder is turnably attached to the pressure adjusting apparatus and urging by the urging apparatus is achieved by air pressure exerted by the air actuator wherein the resistor is formed such that one end edge thereof extending in an axial direction and each of the support pillars are supported by a hinge, while another end edge thereof is interlocked with the urging apparatus so as to be turn able about the hinge.

2. The grinding type vertical grain polishing machine according to claim 1, wherein the bran removing wire-mesh tube is configured as bran removing wire-mesh tube parts that are divided in more than one in a circumferential direction in planar view, and the plurality of support pillars of the resistor apparatus are erected at intervals in the circumferential direction in order to respectively fix both side edges of the bran removing wire-mesh tube parts divided in more than one.

3. The grinding type vertical grain polishing machine according to claim 1, wherein the resistor is formed so as to have an elongated shape long in an axial direction of the grinding type grain cleaning roll member.

4. The grinding type vertical grain polishing machine according to claim 1, wherein, in order to adjust urging force of the resistor at a position at which the resistor protrudes toward an inside of the grain cleaning chamber, each of the support pillars is provided with a resistor apparatus that makes the urging force adjustable by a turn position of a pressure adjusting dial.

5. The grinding type vertical grain polishing machine according to claim 1, wherein each of the support pillars is provided with an external air take-in port and an air jet port, the air jet port is placed on a downstream side of the resistor of the resistor apparatus with respect to a flow of the grains and at a portion close to the resistor, and air is jetted from the air jet port toward the grain cleaning chamber.

6. The grinding type vertical grain polishing machine according to claim 1, wherein the urging by the urging apparatus is achieved by an elastic member.

7. The grinding type vertical grain polishing machine according to claim 1, wherein the urging by the urging apparatus is achieved by an air pressure.

* * * * *